United States Patent [19]

Poterala

[11] Patent Number: 4,644,900

[45] Date of Patent: Feb. 24, 1987

[54] COATING APPARATUS WITH AUTOMATIC TROUGH CONTROL AND SEAM PASSAGE

[76] Inventor: Robert J. Poterala, Rte. 15, Rocky Pointe Way, Greenville, S.C. 29601

[21] Appl. No.: 727,273

[22] Filed: Apr. 25, 1985

[51] Int. Cl.[4] ..... B05C 5/02

[52] U.S. Cl. ..... 118/670; 118/674; 118/413; 118/415; 118/34

[58] Field of Search ..... 118/670, 34, 674, 413, 118/415; 68/200, 205 R

[56] References Cited

U.S. PATENT DOCUMENTS

| | | | |
|---|---|---|---|
| 2,022,322 | 11/1935 | Pelton | 118/415 X |
| 3,402,695 | 9/1968 | Baker et al. | 118/674 |
| 4,089,296 | 5/1978 | Barchz | 118/415 X |
| 4,497,273 | 2/1985 | Matter | 118/415 X |

*Primary Examiner*—John P. McIntosh
*Attorney, Agent, or Firm*—Cort Flint

[57] ABSTRACT

Coating apparatus (10) is disclosed which includes a foam table assembly (A), a coating roll (D), and an automatic trough control system (58). A blade assembly (B) having a coating blade (44) may be selectably positioned over a foam table (20) of the foam table assembly (A) or the coating roll (D) depending upon the type of coating technique desired. A roll mandrel assembly pivotably supports the coating roll (D) by means of a pair of pivot arms (124, 126). Air cylinders (138, 140) provide a constant pressure on the pivot arms which holds the coating roll (D) in a coating position under the constant pressure. The coating roll deflects upon the passage of a thickened seam portion (S) of the fabric. During the deflection, the constant pressure is maintained on the coating roll. The support arms (124, 126) are carried on carriages (102, 106) to move the support arms laterally to accommodate different length coating rolls. The automatic trough control system (48) includes an actuator member (80) which reciprocates in horizontal directions under the influence of an actuator (86) to move a trough (74). The trough is moved to a closed position against the coating blade (44) to prevent the application of coating material should the fabric travel stop. Upon resumption of the fabric travel, the actuator (86) opens the trough to the gap position wherein a desired gap is formed between the trough and the blade.

29 Claims, 5 Drawing Figures

Fig. 3.
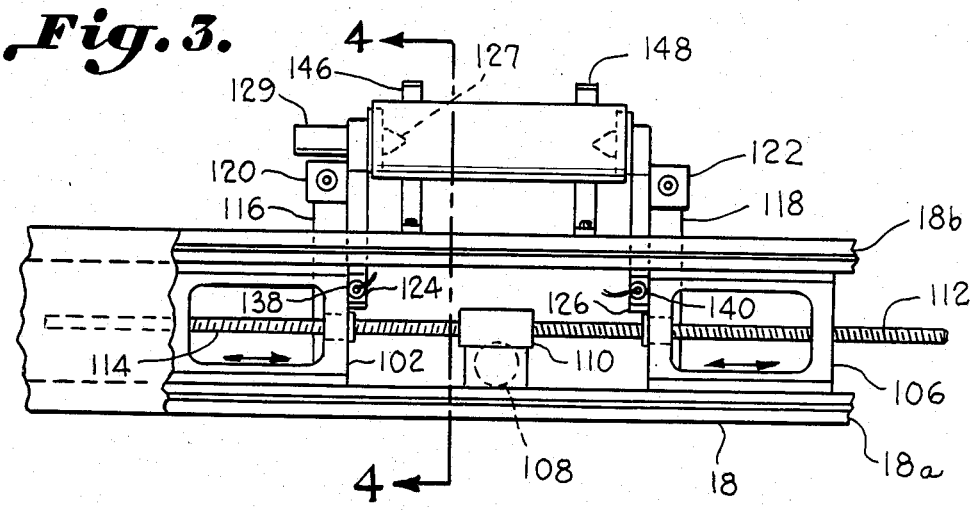
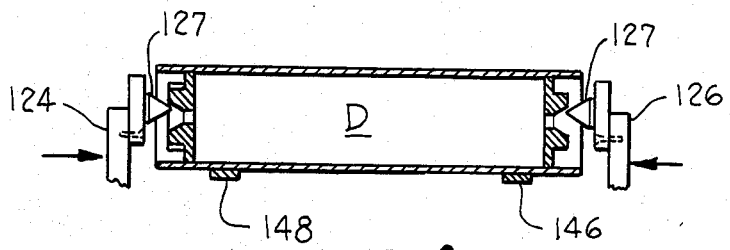
Fig. 5.
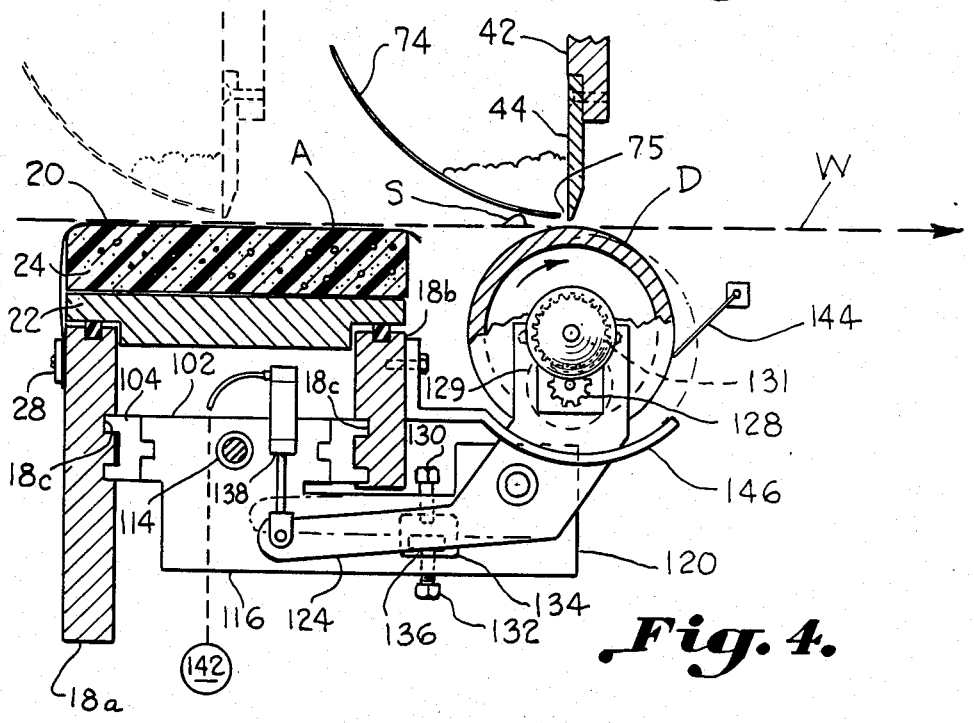
Fig. 4.

COATING APPARATUS WITH AUTOMATIC TROUGH CONTROL AND SEAM PASSAGE

BACKGROUND OF THE INVENTION

The invention relates to a coating machine, and more particularly, a coating machine for coating fabric traveling on the rails of a tenter frame in which an automatic feed trough system closes at tenter stop and opens to a preset position at tenter start.

It is known to support a coating compound above a fabric traveling through a coating machine by means of a trough. A gap between a free edge of the trough and a coating blade allows the coating compound to be deposited on the fabric traveling through the machine and scraped into or applied onto the fabric by the coating blade. One parameter that controls the characteristic of the coating on the fabric is the sink rate. The sink rate is the sink or absorption rate of the coating compound into the fabric which is determined by the amount of time that the coating compound is allowed to stand on the fabric. Utilizing a trough, the coating compound is supported above the surface of the fabric and thus the sink rate may be controlled. A gap may be set between the edge of the trough and the coating blade. This determines the amount of coating compound that is allowed to stand on the fabric and the sink rate.

The problem occurs that when such an apparatus is utilized to coat the fabric traveling on a tenter rail, the tenter is susceptible to stoppage. When the tenter stops, the fabric stops, and the coating compound is allowed to stand and absorb into the fabric longer than usual which alters the coating characteristics. The coating characteristic is also controlled by the pressure between the fabric, as supported on a surface, and the coating blade.

The problem also occurs on such machines of accommodating the passage of a thickened seam portion beneath the coating blade. Typically, such a machine utilizes a support surface over which the fabric travels and against which the fabric is held against the coating blade. When the thickened seam portion approaches the coating blade, impact forces are encountered by the coating blade and the seam since the close clearance between the blade and the support surface do not provide enough space for seam passage. Seam damage and uneven coating occurs in this area. Coating on a foam table lessens impact but provides non-uniform coating in the seam area since the pressure on the foam table is relatively uncontrollable.

U.S. Pat. No. 4,056,423 discloses a rotatable chute which varies the size of an opening through which a material is dispensed. U.S. Pat. No. 4,450,226 discloses a liquid manifold and movable gate which varies an opening in the manifold. Apparently, the gate can also be used to close the manifold. While the above are suitable for their intended applications, the like would not be suitable for trough feeding systems of coating apparatus of the type herein.

U.S. Pat. No. 4,308,823 discloses a coating apparatus which compensates for knot passage. The effective size of the entrance to the coating chamber is increased in order to allow the knots to pass.

In U.S. Pat. No. 4,095,063 a device for detecting a local thickening in a web of paper or film is disclosed. A pivotal sensor roller is utilized over a stationary roller. Pivoting of the roller in response to the passage of a thickening is detected by pivoting of the roller. Similarly, a spring biased roller is disclosed in U.S. Pat. No. 2,614,522 which supports a flexible sheet being coated. The purpose of the spring mounted roller is to maintain the applicator roll in a slightly retracted position in order to prevent the application of coating to the leading edge of the sheet. While spring biased pivoted rollers and vertically displaceable rollers have been known in certain types of coating environments, they have not been devoted to problems inherent in the passage of a thickened seam portion in a coating machine, nor to the solution of the problem provided by the present invention.

Accordingly, an important object of the present invention is to provide a coating machine which is particularly useful for coating fabric traveling on a tenter.

Another important object of the present invention is to provide coating apparatus having a trough feed system wherein the trough automatically closes when the tenter stops and opens to a preset gap position when the tenter starts.

Yet another important object of the present invention is to provide a coating machine having a roll mandrel assembly which deflects in an arcuate motion to allow for seam passage.

Still another important object of the present invention is to provide a roll mandrel for supporting a fabric on a coating machine which deflects in a rearward arcuate motion to allow for seam passage and returns automatically at a constant pressure to a coating position.

SUMMARY OF THE INVENTION

The above objects are accomplished according to the present invention by providing a coating apparatus for applying a coating compound onto fabric traveling on a tenter and the like which includes a frame having a pair of side frame members between which the fabric travels. A blade assembly is carried by the frame which includes a coating blade for applying the coating compound onto the fabric. An automatic trough assembly is carried by the frame which includes a trough for supporting the coating compound above the fabric to control the sink rate. The trough is supported on a slideable trough support which allows the trough to slide in a horizontal direction toward and away from the coating blade. A trough positioning stop is provided for setting the horizontal position of the trough in a desired gap position to define a predetermined gap between a free edge of the trough and the coating blade through which the coating compound is delivered. A closure assembly automatically closes the trough against the coating blade upon stoppage of the tenter, and returns the trough to the gap position automatically upon start of the tenter. A roll mandrel assembly is carried by the frame which includes a coating roll carried in a coating position generally below the coating blade. The coating roll is carried on the mandrel assembly by means of a pivot support which allows the coating roll to deflect in a rearward arcuate motion to allow passage of a thickened seam portion of the fabric. A constant pressure biasing means acts on the pivot support to urge the coating roll into the coating position and exert the pressure against the fabric contacting the coating blade. The constant pressure between the fabric and the coating blade results in even coating characteristics. The constant pressure is continuously exerted on the coating roll as the seam passes between the coating roll and the coating blade so that coating is uniformly accomplished even during seam passage.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 3 is a plan view illustrating a roll mandrel assembly constructed according to the present invention;

FIG. 4 is a sectional view taken along line 4—4 of FIG. 3 illustrating a roll mandrel assembly for deflectably mounting a coating roll to allow for seam passage according to the present invention; and FIG. 5 is an elevation illustrating the automatic pickup of a coating roll by a roll mandrel assembly constructed according to the present invention.

DESCRIPTION OF A PREFERRED EMBODIMENT

Figure 1:
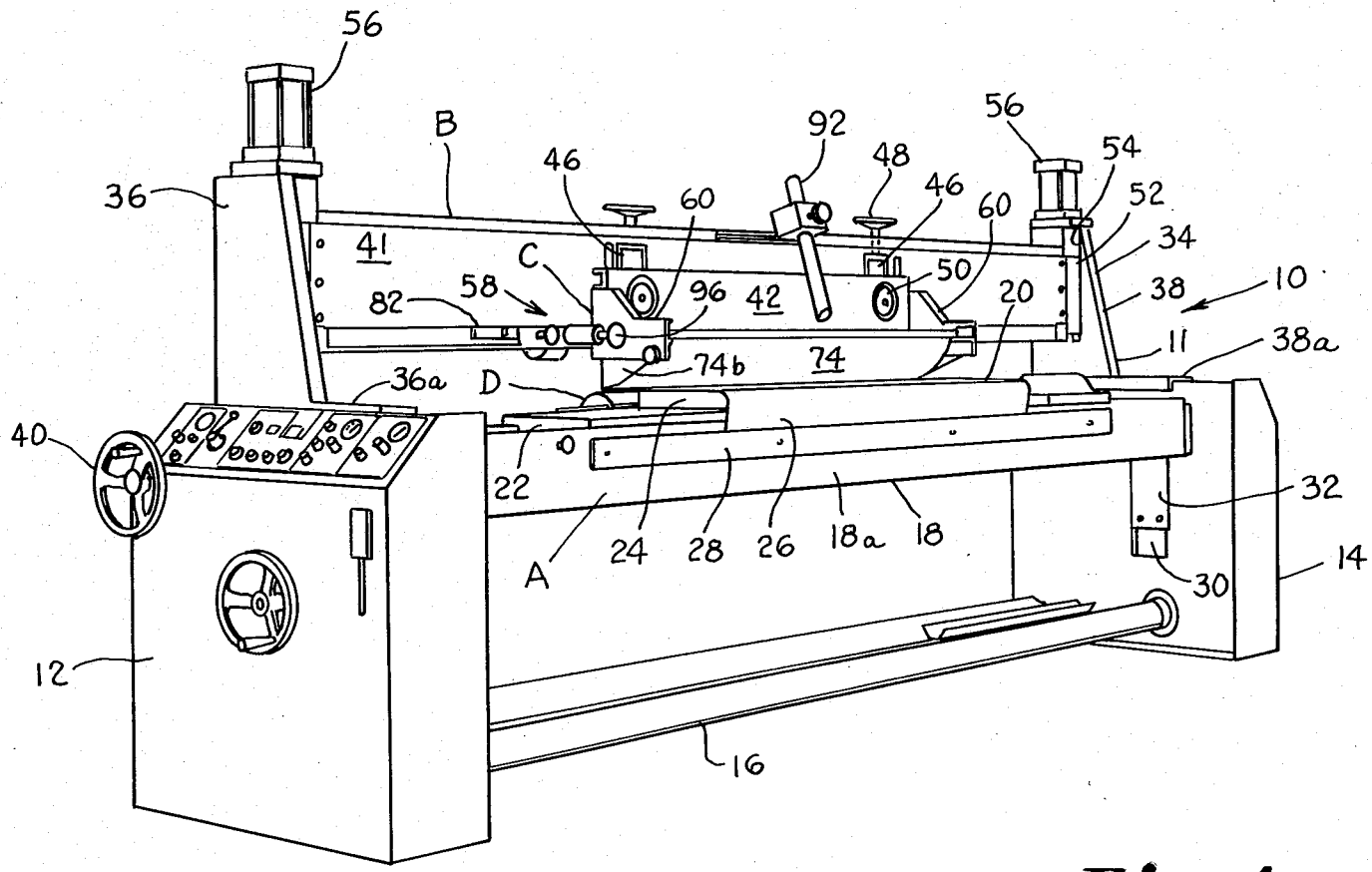
FIG. 1 is a perspective view illustrating apparatus for coating a traveling web of fabric constructed in accordance with the present invention.

Referring now in more detail to the drawings, FIG. 1 illustrates apparatus for coating a web of fabric which travels through a coating machine designated generally as 10. For example, the fabric may be supported on tenter rails which mount through the frame 11 of the coating machine and convey the fabric through the machine to a dryer. The frame 11 includes a pair of side frame members 12 and 14. A pair of horizontal braces 16 space the side frames apart, and generally brace the frame. There is a foam table assembly A which includes a box beam 18 having a pair of parallel spaced side plates 18*a* and 18*b* which provide a support for a foam table 20. There is a top plate 22 which rests on top of the side plates. A piece of foam 24 rests on the plate 22, and a vinyl cover 26 covers the foam material as clamped by a clamping bar at 28 to the box beam to provide a foam table on which the fabric may be coated.

The entire foam table assembly A is carried for vertical movement by the side frame members 12 and 14. For this purpose, a slot 30 is provided in the sides of the side frames which a slide block 32 is slideably received. The slide block is connected to the ends of the box beam 18, and may be moved vertically up and down by a hydraulic jack and motor (not shown). A top frame unit 34 including top side frames 36 and 38 slides on the slide frame members 12 and 14 horizontally. A sleeve 38*a* slideably rests on top of the side frame member 14, as does 36*a*. A turn screw 40 may be provided to move the side frames through a conventional turn screw arrangement (not shown).

A blade assembly B is carried between the top side frames 38 and 36. The blade assembly includes front plate 41, a blade back 42 and a coating blade 44 carried by the blade back. The blade back is vertically adjustable on the front plate 41. The blade back 42 is secured to slide blocks 46 which in turn are threadably mated with a turn screw 48 journaled in plate 41 which adjusts the slide block 46 vertically. The slide blocks are connected to the slide blocks by means of rotatable attachments 50 which allow the ends of the coating blade to be adjusted individually. More detail of an exact manner for attaching the doctor blade for vertical adjustment may be had by reference to a Model TCII coating machine manufactured by the Mascoe Systems Corporation of Mauldin, S.C.

The blade assembly B is secured to the top side frames 36 and 38 by means of an integral slide block 52 at each end of the blade assembly which slide in a slot 54 formed in the opposing interior faces of each top side frame member. Hydraulic cylinders 56 may be utilized to move the blade assembly up and down.

Figure 2:
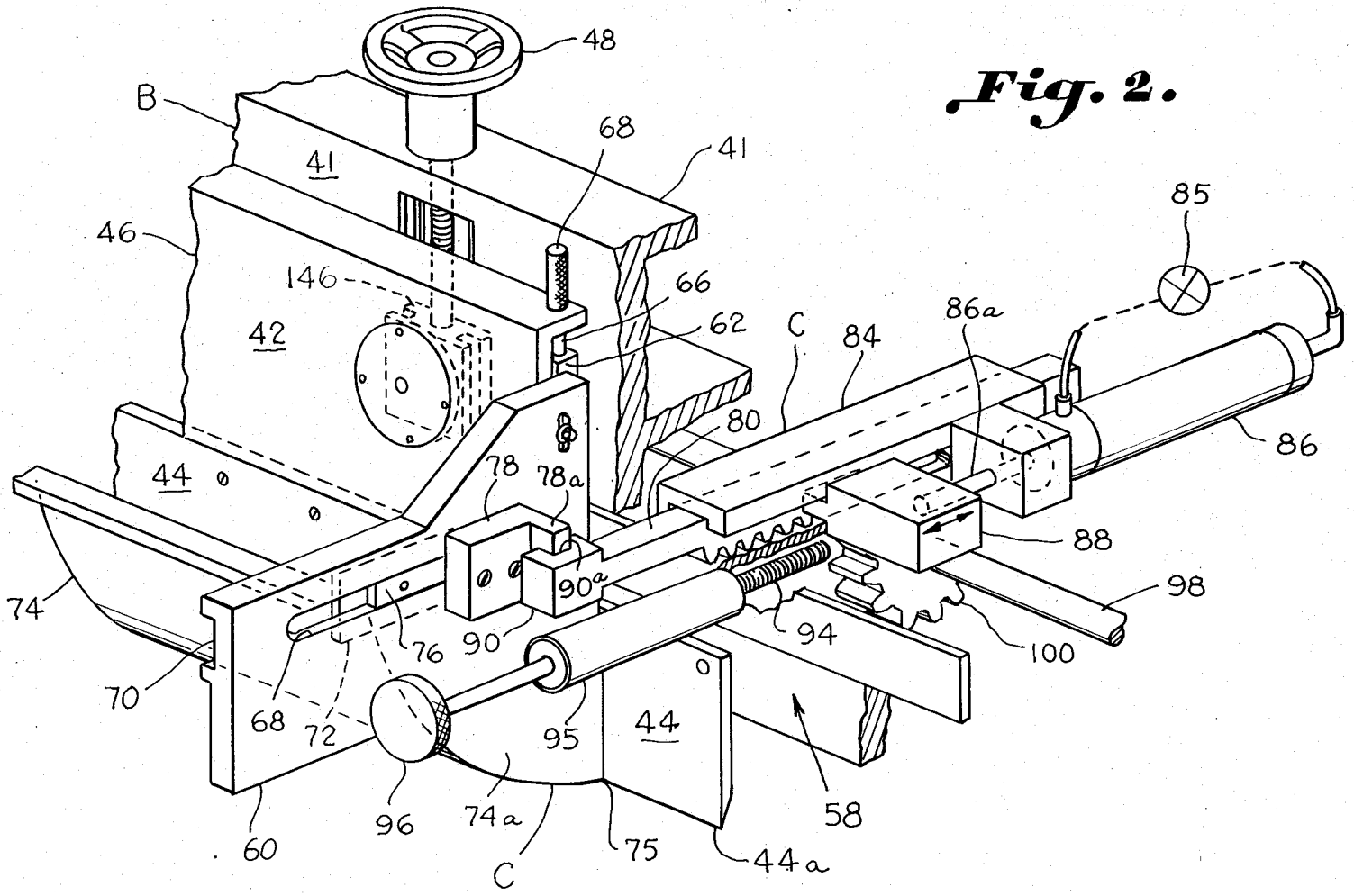
FIG. 2 is a perspective view with parts cut away illustrating an automatic trough control for automatically closing a trough in response to cessation of fabric travel and returning the trough to a preset gap position upon resumption of fabric travel.

An automatic trough assembly, designated generally as 58, is carried by the frame of the coating apparatus. More particularly, as can be seen in FIGS. 1 and 2, the automatic trough system is carried by the blade assembly B. The automatic trough system includes trough support means in the form of support arms 60 which are spaced apart and affixed to the blade back 42 by means of a slide plate 62 wedges between the blade back 42 and front plate 41 of the blade assembly. The slide plate 62 slides on a pin 66 received in a bore in the plate. There is a turn screw 68 also threaded in the slide plate 62 which can be turned to adjust the support arm 60 vertically relative to the coating blade. The support arms are affixed to the slide plate 62.

Slots 68 are machined in the support arms. A slide groove 70 is machined on the opposing interior faces of the support arms which slideably receives a slide block 72 affixed to the ends of a trough 74 carried between the support arms 60. A second block 76 is affixed to the block 72 and slides in slot 68. A connector 78 is affixed to the end of the trough through the slot 68 having a connector leg 78*a*. The trough 74 supports the coating compound above the fabric to control the sink rate and deposits it over a free edge 75 upon the fabric.

An automatic trough closure means C includes actuating means having an acutator member 80 which extends through a slot 82 formed in the front plate 41. A slide housing 84 is affixed to the blade assembly by any suitable means to carry the actuator means. An acutator in the form of a double-acting air cylinder 86 is carried by the housing 84 controlled by a two-way valve 85 either manually or automatically in response to tenter stop and start. A piston rod 86*a* of the actuator 86 is affixed to a block 88 which is in turn affixed to the actuator member 80. An actuator connector at 90 is connected to the end of the actuator member 80 having a U-shaped slot 90a which receives the connector leg 78*a* of the trough.

FIG. 2 illustrates the automatic trough closure means C adjacent a first end 74*a* of the trough 74. An identical closure means C is carried adjacent a second end 74*b* of the trough 74. The second end 74*b* of the trough includes an identical construction mounted in an identical slot in the support arm 60. Likewise, there is a connector 78 carried on the second end 74*b* of the trough connected to a connector 90 of the actuator member. Therefore, the description of the invention as far as an automatic controlled trough will now be described in relation to FIG. 2, and the closure means C illustrated therein at the first end of the trough. Upon detection of the cessation of fabric travel through the coating machine, the air cylinder 86 will be actuated causing the actuating member 80 to move to the right in a first direction sliding the trough tightly against the coating blade 44. Coating compound distributed by a nozzle 92 into the trough is thus prevented from being absorbed into the fabric during cessation of fabric travel. Upon resumption of fabric travel, the actuator 86 is actuated in a second direction away from the coating blade 44 to open a gap between the free edge 75 of the trough and the blade 44.

An adjustable limit 94 is carried by the front plate 41, such as by threading a cylindrical housing 95 into the plate. The adjustable limit 94 is a threaded member which may be extended or retracted by turning a knob 96. The limit 94 contacts the block 88 as the actuator moves in the second direction to stop the travel of actuator member 80, and thus set the gap position of the trough and gap formed thereby.

Means for synchronizing the movement of the first actuator C carried on the first end of the trough, and the second actuator C carried on the second end of the trough so that they act in unison resulting in uniform movement of the trough to and from the doctor blade surface is provided. There is a shaft 98 which is rotatably carried on bearings (not shown) affixed to the back of the blade assembly. There is a gear 100 affixed to the shaft 98. As can best be seen in FIG. 2, the actuator member is in the form of a rack gear whose straight teeth mesh with the gear 100. Thus, as the actuator members 80 extend and retract, the gears 100 and shaft 98 turn. Since the actuators on both ends of the trough mesh with gears, they are synchronized in their movement through the gears in the rotating shaft 98.

The connector means for connecting the actuator member 80 and trough 74 are advantageously shown in the form of the connector 78 and 90 which move together in the horizontal direction, but are allowed to move relative to each other in the vertical direction as the connector leg 78*a* slides in the groove 90*a*. Thus, the trough may be adjusted vertically on the blade assembly so that the edge 75 of the trough may be adjusted relative to the doctor edge 44*a* of the coating blade.

As described previously, the apparatus may be utilized to coat the fabric either over the coating roll D or the foam table A as can best be seen in FIG. 4.

Referring now in more detail to FIGS. 3 through 5, a roll mandrel assembly for supporting the coating roll D in a manner which allows seam passage will be described. There is a first slide carriage 102 slideably carried between the sides 18*a*, 18*b* of the box beam 18. There are nylon slide inserts 104 affixed to the carriage to facilitate sliding of the carriage 102 which is received in grooves 18*c* formed in the plates 18*a*, 18*b*. There is a second identical carriage 106 carried spaced apart from carriage 102. There is an air motor 108 having an output shaft connected to a gear box 110 which drives a pair of screws 112 and 114. The screw 114 is connected to the first carriage 102 and the screw 112 is connected to the second carriage 106. The air motor is driven from a suitable source of regulated air. There is an arm 116 affixed to the carriage 102, and an identical arm 118 affixed to carriage 106. There is a pivot bearing block 120 affixed to the arm 116, and an identical bearing block 122 affixed to the arm 118. There is a first L-shaped pivot arm 124 pivotally attached to the bearing block 120. There is an identical L-shaped pivot arm 126 pivotally attached to the bearing block 122.

Each L-shaped pivotal arm 124, 126 includes a first horizontal leg 124*a*, 126*a*, and a second vertical leg 124*b*, 126*b*. The vertical legs of the pivot arms carry attachment centers 127 which fit within an opening 128 formed in the opposing ends of the coating roll D along its axial center. As the carriages 102 and 106 move towards each other, the point centers 127 are forced in the openings of the coating roll to support it on the roll mandrel assembly. There is a drive gear 128 driven by a hydraulic motor 129, which meshes with a gear 131 affixed to the coating roll to rotate the coating roll accordingly.

Pivot limit means are provided by a first adjustable stop 130 carried by the arm 116, and a second adjustable stop 132 carried by the arm 116. Both threaded stops penetrate into a cavity 134 formed in the arm 116. There is a lateral abutment flange 136 carried by the pivot arm 124 which moves between the stops 130 and 132 as the arm pivots. The same construction is included in the pivot arm 126.

A pair of air cylinders 138 and 140 are utilized as biasing means to hold the pivot arms and coating roll in place. In order for the coating roll to be deflected rearwardly and downwardly, the pressure of the air cylinders must be overcome. The air cylinders are affixed to the carriages, and their piston rods are connected to the first legs 124*a* and 126*a* of the L-shaped pivot arms. The air pressure forces the legs downwardly and the coating roll D upwardly to a coating position shown in full lines in FIG. 4. The coating roll is allowed to deflect by a seam S passing under the coating blade to the dotted line position. A conventional air regulator 142 is utilized to sense the pressure on the air cylinders when the seam forces the coating roll backwardly and downwardly in a rearward arcuate motion. Once a certain pressure is reached on the air cylinder, the air regulator opens and bleeds off the air pressure to the cylinder. The regulator bleeds of air to maintain uniform pressure in the air cylinder. For example, if the air cylinder is set at 50 psi, and the pressure builds up to 60 psi during roll deflection, the regulator will open to bleed off 10 lbs. of pressure.

The pivot of the coating roll is designed so that upon the thickened seam portion S engaging the coating blade, the roll is caused to deflect in a rearward arcuate motion in which the horizontal component direction is approximately four times as great as the vertical component direction. This facilitates seam passage without damage or uneven coating. The roll deflects rearwardly generally along the same path with the seam upon initial impact to lessen impact forces. The constant pressure of the air cylinders keeps the seam in contact with the coating blade so that coating compound is applied evenly over the seam while deflecting for seam passage. The radius arm from the pivot point of the pivot bearing block 120 to the point of tangentency of the fabric is approximately 9 inches.

The upper adjustable stop 130 limits the rearward arcuate motion of the coating blade. When it is desired to use the foam table for coating rather than the coating roll, the stop 130 is threaded out so that the roll may deflect out of the way to the travel of fabric. In this case, the blade assembly is moved horizontally over the side frame members 12 and 14 to position the coating blade 44 over the foam table. When the coating blade is used over the coating roll, it may be used in two different types of coating. First, there is gap coating where a measured distance is between the coating blade and the roll. This applies a layer of coating material onto the fabric corresponding to the gap distance between the blade and roll. The blade assembly may be raised or lowered to set this gap. Additionally, the vertical adjustment of the blade by turn screws 48 may be made to fine adjust the gap.

Secondly, there is scrape coating where the coating roll applies a pressure against the coating roll with the fabric therebetween. The pressure can be adjusted by adjusting the pressure on the air cylinders. The coating roll holds the fabric against the coating blade with a certain amount of pressure. When the seam comes through the machine, the roll deflects in the rearward arcuate motion. The air pressure holds the pressure against the blade during fabric coating as well as seam passage. The pressure of the coating roll against the coating blade also determines the coating characteristic achieved by the apparatus.

Referring now to the drive of the coating roll, there is provided the hydraulic motor 130 for the drive gear 128 to drive the roll. A tachometer may be utilized to measure the speed of the fabric on the tenter frame. The tachometer signal may be fed to a conventional variable speed drive unit (not shown) which calculates the speed and regulates a conventional hydraulic pump (not shown) which then supplies hydraulic fluid to the hydraulic motor 130 accordingly. The hydraulic motor drives the coating roll in a first rotational direction in the direction of fabric travel. In another application, the coating roll is driven in a reverse direction and a doctor blade 144 is utilized to scrape the coating material from the roll to always present a clean surface to the fabric. This is particularly useful when coating porous fabric, like gauze.

Referring now FIG. 5, it can be seen that a pair of cradle blocks 146, 148 are attached to the frame of the coating machine. When installing a coating roll D of a different length, the coating roll may be laid in the cradle blocks. The screws 114 and 112 are then driven by the air motor 108 until the carriages bring the pivot arms and point centers 127 together. The conical point members pick up the roll automatically and bring it up to position. When the air motor 108 reaches a certain torque indicating that the roll is tightly held, the air motor can be cut off and the screws hold the carriages in position with the coating roll tightly in place.

While a preferred embodiment of the invention has been described using specific terms, such description is for illustrative purposes only, and it is to be understood that changes and variations may be made without departing from the spirit or scope of the following claims.

What is claimed is:

1. Coating apparatus for coating a traveling web of fabric with a coating compound comprising:

a frame having a pair of side frame members between which said fabric travels;

a blade assembly carried by said frame having a coating blade for applying said coating compound on said fabric;

a trough assembly carried by said frame;

a trough included in said trough assembly for containing said coating compound to support said coating compound above the surface of said fabric to control the sink rate into said fabric;

trough support means for supporting said trough in a position in which said coating compound is dispensed over an edge of said trough onto said fabric;

said trough support means slideably supporting said trough on said trough assembly in a horizontal direction;

trough positioning means for setting the horizontal position of said trough in a desired gap position to define a predetermined metering gap between said edge of said trough and said coating blade;

closure means for moving said trough against said coating blade to close said gap during cessation of said web travel, and for returning said trough to said gap position automatically upon resumption of web travel;

a roll mandrel assembly carried by said frame including a coating roll carried by said mandrel assembly generally below said coating blade;

pivot means carrying said coating roll on said mandrel assembly for movement in a rearward arcuate motion having a horizontal and vertical component to allow passage of a thickened seam of said fabric;

biasing means acting on said pivot means to urge said coating roll in an upward direction to a coating position in which said web of fabric travels over said roll with said coating blade applying said coating compound onto said fabric; and said biasing means exerting an even pressure on said coating roll against said fabric and coating blade during coating and during said rearward arcuate motion.

2. The apparatus of claim 1 wherein said closure means includes actuating means for moving said trough in a first direction toward said coating blade, and a second direction away from said coating blade;

connector means carried by said actuating means for connecting said actuating means to said trough;

said trough positioning means including adjustable stop means for limiting movement of said actuating means in said second direction to fix said trough in said gap position upon actuation of said actuating means in said second direction.

3. The apparatus of claim 2 wherein said actuating means includes a first actuating means carried adjacent a first end of said trough, and a second actuating means carried adjacent a second end of said trough; and said connector means connecting each of said first and second actuating means to the respective first and second end of said trough.

4. The apparatus of claim 3 including synchronization means interconnecting said first and second actuating means, whereby said actuating means move said first and second ends of said trough in unison with each other.

5. The apparatus of claim 2 where in said connector means includes a first connector affixed to said actuating means, a second connector affixed to said trough, and said first and second connectors being interlocked for movement together in said first and second directions while said first and second connectors are interconnected for movement relative to each other in a vertical direction so that said trough is free to move vertically with respect to said coating blade.

6. The apparatus of claim 2 wherein said closure means includes:

a rack gear carried for movement in said first and second directions having an abutment block carried by said rack gear;

said abutment block engaging said adjustable stop means to limit movement of said rack gear in said second direction to set said metering gap;

said connector means being affixed adjacent an end of said rack gear.

7. The apparatus of claim 6 comprising:

a first rack gear connected to a first end of said trough by said connector means;

a second rack gear connected to a second end of said trough by said connector means;

said actuating means reciprocating said rack gears in said first and second direction in response to cessation and resumption of travel of said fabric; and synchronization means interconnecting said first and second rack gears whereby they move in unison with each other.

8. The apparatus of claim 1 comprising:

a foam table assembly carried by said frame, means for selectively positioning said coating blade over said foam table assembly or said coating roll; and said pivot means moving said coating roll out of the path of said fabric when said coating blade is over said foam table assembly.

9. The apparatus of claim 1 wherein said pivot means supports said roll so that said horizontal component of said rearward arcuate motion has a greater magnitude than said vertical component of said rearward arcuate motion so that upon initial seam impact said coating roll deflects generally with said seam to lessen the impact of said seam.

10. The apparatus of claim 1 wherein said roll mandrel assembly includes:

a pair of pivot arms having first and second legs included in said pivot means;

attachment centers carried by said first legs about which said support roll is carried axially centered;

said biasing means including biasing said second legs of said pivot arms downward with a constant regulated pressure, and urging said first legs and coating roll upwards to said coating position.

11. The apparatus of claim 10 including:

a first carriage slideably carried by said frame, and a second carriage slideably carried by said frame;

a first of said pivot arms carried by said first carriage, and a second of said pivot arms carried by said second carriage; and means for moving said first and second carriages toward and away from each other transversly to the direction in which said fabric travels;

whereby said centers may be moved closer and further away from each other to support different length coating rolls on said roll mandrel assembly.

12. Coating apparatus for applying a coating compound to a web of fabric traveling along a path such as on a tenter, said apparatus being of the type which includes a coating surface over which said web of fabric travels; a coating blade carried above said coating surface which applies said coating compound onto said fabric, and a trough for supporting said coating compound above said fabric to control the sink rate into said fabric, said trough having an edge over which said coating compound is dispensed onto said fabric, wherein the improvement comprises:

an automatic trough control assembly which includes trough support means for slideably supporting said trough in a horizontal direction;

actuating means for moving said trough in a first direction toward said coating blade and a second direction away from said coating blade;

connector means connecting said actuating means to said trough;

said actuating means moving said trough in said second horizontal direction to establish a gap between said edge of said trough and said coating blade;

adjustable stop means for limiting the movement of said actuating means in said second direction to stop the movement of said trough at a predetermined distance and gap position to establish a desired gap between said coating blade and said edge of said trough; and means for actuating said actuating means in response to the cessation of travel of said fabric through said apparatus to cause said actuating means to move said trough against said coating blade to a closed position, and for automatically returning said trough to said gap position upon resumption of the travel of said fabric.

13. The apparatus of claim 12 wherein said trough support means includes:

a pair of spaced apart support arms carried by said blade having a horizontal slot formed therein;

a slide groove formed on opposing facing sides of said support arms in which said first and second ends of said trough slide;

said connector means including a connector connecting said first and second ends of said trough through said slots to said actuating means.

14. The apparatus of claim 12 wherein said actuating means includes:

a rack gear for horizontal movement in said first and second directions;

said connector means including a first connector carried by said rack gear, and a second connector connected to said trough, said first and second connectors having interlocking portions being interconnected with one another;

said actuating means for reciprocating said rack gear in said first and second directions.

15. The apparatus of claim 14 including:

an abutment block carried by said rack gear;

said adjustable stop limit engaging said abutment block to limit the movement of said rack gear in said second direction and set said trough in said gap position; and said actuating means reciprocating said rack gear in said first and second directions to move said trough to said closed position and said gap position.

16. The apparatus of claim 12 wherein said actuating means comprises a first actuating means carried adjacent a first end of said trough, and a second actuating means carried adjacent a second end of said trough;

said connector means connecting said first actuator means and said first end of said trough, and connecting said second actuating means and said second end of said trough; and synchronization means interconnecting said first and second actuating means whereby said actuating means move in unison with each other to move said trough evenly against said coating blade in said closed position, and to provide a uniform gap between said trough and said coating blade in said gap position.

17. Coating apparatus for applying a coating compound to a web of fabric traveling along a path such as on a tenter of the type which includes a coating support surface over which said fabric travels, a coating blade carried above said coating support surface which applies said coating compound to said fabric, and a trough for supporting said coating compound above said fabric to control the absorption rate of said coating compound, wherein the improvement comprises:

a roll mandrel support assembly which includes:

a coating roll providing said coating support surface for supporting said fabric beneath said coating blade for application of said coating compound;

pivot means for pivotably carrying said support roll on said roll mandrel assembly for deflection in a rearward arcuate motion having a vertical and horizontal component of direction to allow for seam passage between said coating blade and coating roll;

means for applying a biasing force urging said coating roll upwardly to a coating position so that passage of a seam between said coating blade and support roll causes said roll to deflect in said rearward arcuate motion.

18. The apparatus of claim 17 wherein said horizontal component of said rearward arcuate motion has a greater magnitude than the vertical component of direction so that said coating roll moves generally along the same path as said seam immediately following initial impact to lessen the impact forces.

19. The apparatus of claim 17 wherein said pivot means comprises a pair of L-shaped arms pivotally carried by said frame having a first and second leg;

point attachment centers carried on said first leg to affix said support roll on said mandrel assembly along the axial center of said roll; and bearing means included in said attachment centers whereby said support roll rotates on said mandrel assembly.

20. The apparatus of claim 19 wherein said biasing means includes air cylinders operatively connected to said pivot arms;

said air cylinders exerting a constant desired pressure on said pivot arms to urge said coating roll upwards to a coating position in which fabric travels over said roll for coating; and means for regulating the pressure delivered to said air cylinders so that constant pressure is exerted on said roll against said fabric during coating and during deflection of said coating roll upon seam passage.

21. The apparatus of claim 17 including drive means for rotating said coating roll on said mandrel assembly, said drive means rotating said coating roll in a first rotational direction and in a second rotational direction opposite to said first rotational direction; and doctoring means for scraping coating compound from the surface of said support roll when rotated in said second rotational direction to present a clean support roll surface to said fabric facilitating use with porous fabrics.

22. The apparatus of claim 17 including:

first pivot limit means for limiting the rearward arcuate motion of said support roll, and second pivot limit means for limiting movement of said coating roll at said coating position.

23. The apparatus of claim 17 including drive means for rotating said coating roll; and doctor means for engaging said roll to scrape coating material from said roll surface continuously to clean said roll surface during coating of porous fabric.

24. The apparatus of claim 17 wherein said mandrel roll assembly includes a first carriage and a second carriage slideably carried by a frame in lateral directions transverse to the direction of fabric travel;

said pivot means including a first pivot arm carried by said first carriage and a second pivot arm carried by said second carriage;

motor means for moving said first and second carriages in synchronization with one another;

an attachment center carried by said pivot arms for engaging said coating roll along its axial center for supporting said roll in said assembly; and means for moving said first and second carriages towards and away from each other to support different length coating rolls.

25. The apparatus of claim 24 comprising auxiliary support means for holding said coating roll prior to said attachment centers engaging said coating roll from opposing ends permitting said centers moved by said carriages to automatically pick up said coating roll and move it from said auxiliary support means to said supported position on said roll mandrel assembly.

26. The apparatus of claim 25 wherein said motor means automatically terminates upon engagement of said coating roll by said attachment centers.

27. A coating apparatus for coating a fabric traveling on a tenter and the like comprising:

a coating roll;

a coating blade carried above said coating roll whereby said fabric travels with pressure between said coating roll and said coating blade;

a feed trough carried adjacent said coating blade for containing a coating compound above the surface of said fabric to control the sink rate of said coating compound;

said trough having a gap position in which a desired gap is formed between an edge of said trough and said coating blade over which said coating compound is applied to said fabric;

said trough having a closed position against said coating blade in which said coating compound is prevented from being applied to said fabric;

means for moving said trough to said closed position upon cessation of said tenter and automatically returning said trough to said gap position upon the start of said tenter; and means for pivoting said coating roll in a rearward arcuate motion to allow passage of a thickened seam of said fabric, said rearward arcuate motion having a horizontal and vertical component of direction.

28. The apparatus of claim 27 wherein said means for pivoting said coating roll include:

a pair of pivoting arms having attachment centers which support said coating roll along the axial center of said coating roll; and means for moving said pivotal arms toward and away from each other in a lateral motion to adjust and support different length coating rolls.

29. The apparatus of claim 27 including:

means for exerting a constant upward pressure on said coating roll against said coating blade during the travel of fabric therebetween and during the rearward arcuate motion of said coating roll.

* * * * *